US008312830B2

(12) United States Patent
Carlson

(10) Patent No.: US 8,312,830 B2
(45) Date of Patent: Nov. 20, 2012

(54) THREADING DEVICE

(76) Inventor: Eric Carlson, Torslanda (SE)

( * ) Notice: Subject to any disclaimer, the term of this patent is extended or adjusted under 35 U.S.C. 154(b) by 284 days.

(21) Appl. No.: 12/937,267

(22) PCT Filed: Apr. 7, 2009

(86) PCT No.: PCT/EP2009/054145

§ 371 (c)(1),
(2), (4) Date: Oct. 10, 2010

(87) PCT Pub. No.: WO2009/124934

PCT Pub. Date: Oct. 15, 2009

(65) Prior Publication Data

US 2011/0030605 A1 Feb. 10, 2011

(30) Foreign Application Priority Data

Apr. 11, 2008 (WO) ..... PCT/SE2008/050418

(51) Int. Cl.
*B63B 21/00* (2006.01)

(52) U.S. Cl. ..... 114/230.26

(58) Field of Classification Search ..... 114/230.1, 114/230.26, 221 R; 226/91, 92; 29/241; 294/19.1, 101, 191, 209, 210, 211; 104/182
See application file for complete search history.

(56) References Cited

U.S. PATENT DOCUMENTS 4,560,098 A * 12/1985 Tupper ..... 226/92

FOREIGN PATENT DOCUMENTS

GB 287407 A 3/1928

* cited by examiner

*Primary Examiner* — Daniel Venne
*Assistant Examiner* — Anthony Wiest
(74) *Attorney, Agent, or Firm* — David A. Guerra

(57) ABSTRACT

The invention relates to a threading device (1) for the threading of a line through a ring member or the like that comprises a body (2), a rotatable arc-shaped element (14) suspended in the body and having an opening (26), and a line holding means (16) arranged to slide on the arc-shaped element, where the arc-shaped element is adapted to assume a first position with the opening in a first direction and a second position with the opening in a second position, and where the threading device further comprises transfer means (18) adapted to transfer a movement to the outer surface of the arc-shaped element in order to rotate the arc-shaped element between the first and the second position. The advantage of the invention is to provide a threading device that is easy to operate, that can be used by both pushing and pulling and that can be manufactured in a cost-effective way.

20 Claims, 10 Drawing Sheets

THREADING DEVICE

CROSS-REFERENCE TO RELATED APPLICATIONS

This application is an U.S. national phase application under 35 U.S.C. §371 based upon co-pending International Application No. PCT/EP2009/054145filed on Apr. 7, 2009. Additionally, this U.S. national phase application claims the benefit of priority of co-pending International Application No. PCT/EP2009/054145filed on Apr. 7, 2009, and International Application No. PCT/SE2008/050418filed on Apr. 11, 2008. The entire disclosures of the prior applications are incorporated herein by reference. The international application was published on Oct. 15, 2009under Publication No. WO 2009/124934.

TECHNICAL FIELD

The present invention relates to a threading device for threading a line through an opening, such as threading a mooring line of a boat through a mooring ring mounted on a buoy or at a fixed position on shore. One advantage of the threading device is that the threading operation can be performed from a remote position.

BACKGROUND ART

One of the difficulties with leisure boats of different sizes is the mooring of the boat to one or more mooring buoys and/or to one or more mooring rings. A mooring ring may be mounted to a pier or a landing-stage in a harbour where the boat is at home. A mooring ring may also be mounted in a rock or the like in a natural harbour.

The problem when landing with a boat is that the mooring or holding lines must be thread through the mooring ring if one wants to avoid tying a knot in the mooring ring itself. Very often, the mooring ring is situated at a distance from the boat and the person that is to thread the line through the ring. In one example, the person is high above the mooring buoy, e.g. if the boat is a larger sailing boat. In this case, the person must stretch over the railing. In another example, the ring is mounted in a rock or cliff in a natural harbour. The cliff may be steep and/or slippery, so that the landing of a person in order to reach the ring may be difficult or even dangerous. The landing may even be impossible if the draught of the boat and the depth of the water prevent the boat from landing.

The problem of mooring a boat is growing, due to the increase in the number of leisure boats and also due to the increase in the average boat size. The larger the boat is, the more difficult it is to the reach a mooring ring. The problem is increased even further since several of the boat-owners of today are less experienced to steer and handle a boat, especially when it comes to larger boats.

Different devices have been proposed in order to help a person to thread a line through an opening in a ring or the like.

U.S. Pat. No. 4,560,098 relates to a device suitable for threading a line through a ring member or the like. The threading device comprises a body part, a rotor part comprising at least one wheel having a recess in its periphery and a threading member cooperating with the wheel. This solution may work in some cases, but is adapted for a threading action in a predetermined direction. The wheel is biased to a specific start position. The device is also rather limited regarding the sizes of ring members and lines to which it may work. Since the force to rotate the wheel is applied directly on the wheel, there is a limitation in the obtainable torque since the lever arm will be rather short. The threading member is suspended floatingly on the wheel which makes the construction rather weak. The device can not be used as a regular boat hook.

In DE 10 2006 029 810 A1, another device for threading a line through a ring member or the like is shown. This device comprises a wheel rotatable in one direction, having a hole for the line and a recess adapted for the ring member. The device must be moved in two different directions in order to thread a line through a ring member because the force to rotate the wheel is applied directly on the wheel. The obtainable torque will thus be rather limited since the lever arm will be rather short. The first movement must be a downwards pushing movement before a pulling movement is used to complete the threading. The threading can not be reversed. The threading requires a rather high precision of the user which may be difficult to achieve from a moving boat. The device is rather limited regarding the sizes of ring members and lines to which it may work. The device can not be used as a regular boat hook during the threading operation.

GB 287,407 and GB 442,857 show two further examples of threading devices. Both are rather complicated and require a specific looped line end to function. Both must be manually brought to a specific starting position before they can be used and both can only be used in one direction. Both devices are not suitable for the use as regular boat hooks.

All the known threading devices show some drawbacks. There is thus room for an improved threading device.

DISCLOSURE OF INVENTION

An object of the invention is therefore to provide an improved threading device for threading a line through a ring member or around an object. Another object of the invention is to provide an improved threading device that requires an operation in one direction only for the threading cycle. A further object of the invention is to provide an improved threading device that can thread a line with either a pushing action or a pulling action.

With a threading device for the threading of a line through a ring member or the like, comprising a body, a rotatable arc-shaped element suspended in the body and having an opening, and a line holding means arranged to slide on the arc-shaped element, where the arc-shaped element is adapted to assume a first position with the opening in a first direction and a second position with the opening in a second position, the object of the invention is achieved in that the threading device further comprises transfer means adapted to transfer a movement to the outer surface of the arc-shaped element in order to rotate the arc-shaped element between the first and the second position.

By this first embodiment of the threading device according to the invention, a threading device is obtained which can be operated at a distance from the ring member and that allows the arc-shaped element to rotate freely since an outer movement is transferred to the arc-shaped element. The outer movement will rotate the arc-shaped element regardless of the position of the contact surface between the ring member and the arc-shaped element. The threading device is thus not depending on a specific torque lever for the rotation of the arc-shaped element.

In an advantageous further development of the threading device according to the invention, the movement transferred to the arc-shaped element is longitudinal and the transfer means is a ball chain. In this way, e.g. a pulling movement from a handle can be used to rotate the arc-shaped element and thus to thread the line. The use of a ball chain will also provide for a treading device where few parts are required, since the ball chain can be guided in sliding contact with the housing. This makes for a simple and cheap threading device that is easy to use.

In an advantageous further development of the threading device according to the invention, the movement transferred to the arc-shaped element is longitudinal and the transfer means is a beam. In this way, e.g. a pulling movement from a handle can be used to rotate the arc-shaped element and thus to thread the line. This makes for a threading device that is easy to use.

In an advantageous further development of the threading device according to the invention, the arc-shaped element comprises a plurality of teeth on its outer surface. The beam will also comprise a plurality of teeth. This will give a slip-free transfer of the movement to the arc-shaped element. The starting position and the end position will thus stay the same.

In an advantageous further development of the threading device according to the invention, the threading device further comprises a plurality of toothed wheels adapted to transfer the movement of the rack to the arc-shaped element, In another development, a toothed belt is used to transfer the movement. The advantage of this is that a robust threading device is obtained in which the arc-shaped element can be rotated even though the opening of the arc-shaped element pass the toothed wheels.

In an advantageous further development of the threading device according to the invention, the movement is achieved by the pulling or the pushing of a handle. This allows for an easy and simple operation of the threading device, since no external levers or the like has to be operated.

In an advantageous further development of the threading device according to the invention, the line holding means is adapted to rotate over the opening in the arc-shaped element. In this way, a simple threading device is provided for.

BRIEF DESCRIPTION OF DRAWINGS

The invention will be described in greater detail in the following, with reference to the embodiments that are shown in the attached drawings, in which.

MODES FOR CARRYING OUT THE INVENTION

The embodiments of the invention with further developments described in the following are to be regarded only as examples and are in no way to limit the scope of the protection provided by the patent claims. In the examples, a mooring ring is used as an example through which a line is to be treaded. It should be understood that the inventive threading device is also suited for the threading of a line, rope or even a wire or a cable through any suitable opening or around a pole or the like or even around a rope. The device may also be used for threading a line or rope for other purposes than marine use, e.g. when hanging a tarpaulin or the like.

Figure 1:
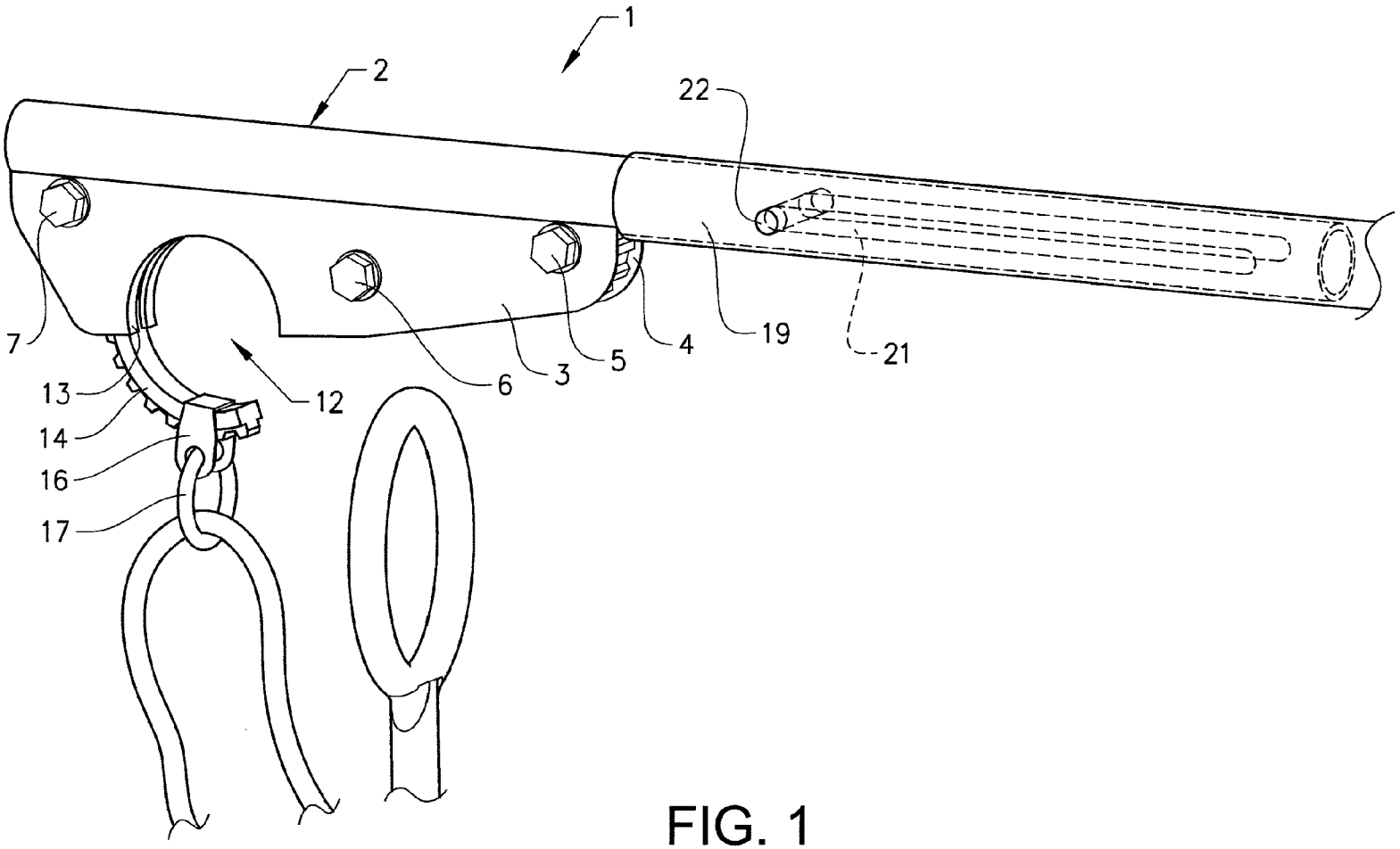
FIG. 1 shows a first embodiment of a threading device according to the invention.
Figure 2:
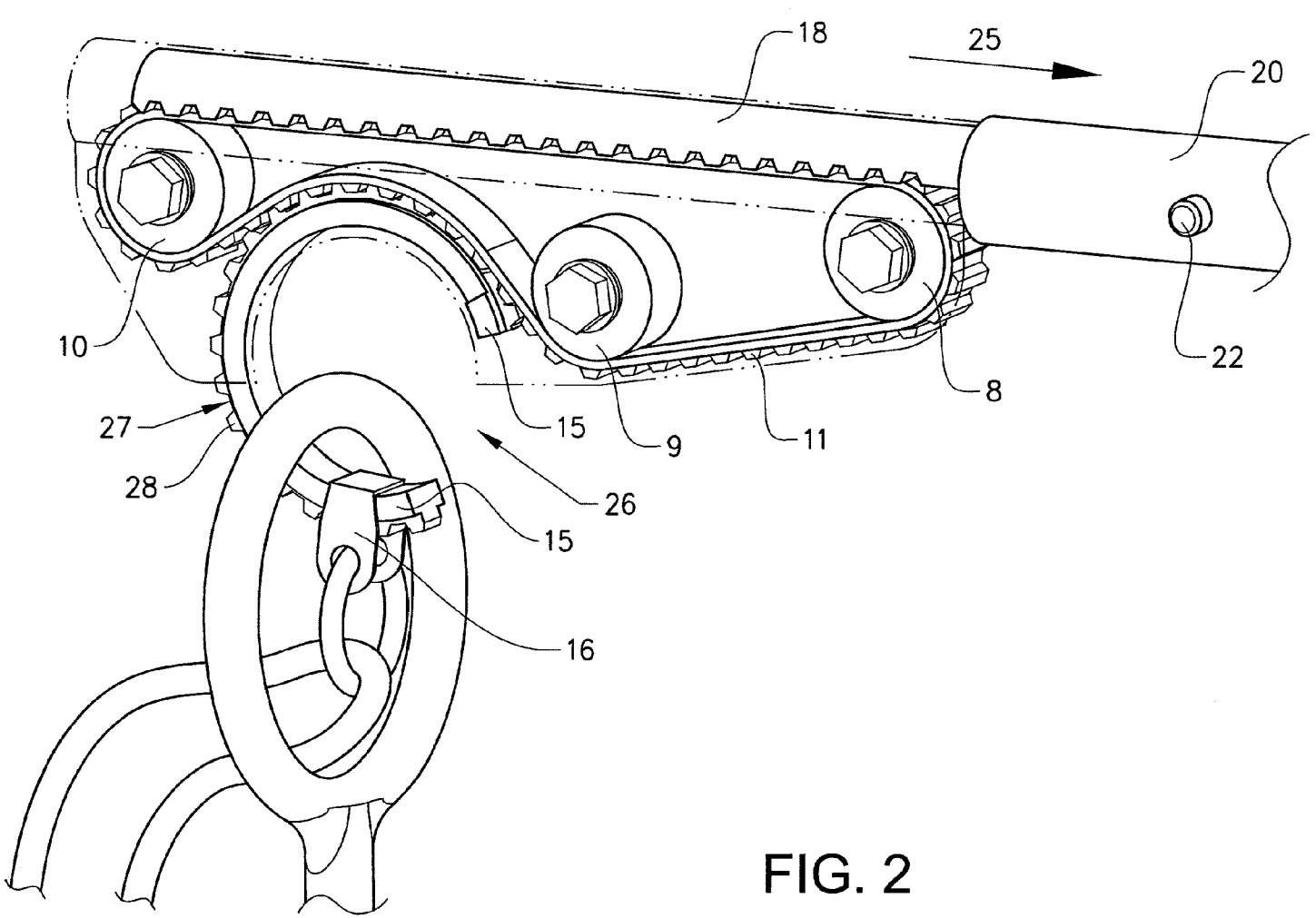
FIG. 2 shows a split view of the first embodiment of a threading device according to the invention.

FIGS. 1 and 2 show a first embodiment of the inventive threading device. The threading device 1 comprises a body portion 2 having a first side wall 3 and a second side wall 4. The first side wall 3 and the second side wall 4 are parallel and are positioned apart with a predefined distance. The side walls are held in position by a number of spacers. Each spacer is fastened to the body by e.g. bolts or screws that may be countersunk or may have a fiat head. In the shown example, a first bolt 5, a second bolt 6 and a third bolt 7 are used with corresponding spacers. On each spacer, a wheel is rotatable suspended. On the spacer of the first bolt 5, a first wheel 8 is suspended, on the spacer of the second bolt 6, a second wheel 9 is suspended and on the spacer of the a third bolt 7, a third first wheel 10 is suspended. The wheels can rotate freely and are preferably made from a low friction material, e.g. a thermoplastic such as polyamid or polyacetal.

A belt 11 runs on the wheels. The belt is adapted to transfer the longitudinal movement of a beam 18 to an arc-shaped element 14. The transfer of the movement is preferably done in a high-friction manner such that the belt does not slip or skid either on the beam or the arc-shaped element. In this example, the belt is provided with teeth 28 in order to prevent slippage, but also other means to prevent slippage are conceivable. The teeth of the belt are directed outwards from the wheels.

The body 2 further comprises a half-circular or part-circular recess 12 having a perpendicular rim 13 which closes the recess 12 to the inside of the body. The rim may also be used as a contact surface when the threading device is used as a regular boat hook. Inside the body, and on the inner side of the rim, a circular arc-shaped element 14 is arranged. In this example, the arc-shaped element is provided with teeth 28 on the outer surface 27. The toothed arc-shaped element extends out of the body and is part-circular with an opening 26 preferably in the range between 60 and 120 degrees. The opening in the arc-shaped element is determined on the one hand by the size of the mooring ring or the like with which the threading device is to cooperate, and on the other hand by the position of the second and third wheels.

The cross section of the arc-shaped element may have any shape, but is preferably rectangular with the teeth extending outwards from the centre of the arc-shaped element. The relation between the width and the height of the arc-shaped element is preferably in the range between 1:4 and 4:1, even if a wider arc-shaped element is also possible. The arc-shaped element will be held in position by, and can rotate on, the inside of the rim. Optionally, the toothed arc-shaped element may also comprise grooves or channels in the side surface that fit in corresponding grooves in the body. In this way, the arc-shaped element can be held in position without too much play, since the shoulders 15 of the arc-shaped element must pass through the house. At each end of the arc-shaped element, at the opening, a shoulder 15 is arranged. The shoulder extends somewhat from the side surfaces of the arc-shaped element and is designed to prevent a line holding means 16 from falling of the arc-shaped element. In the shown example, the line holding means 16 is a slidable clamp which is provided with a ring 17. The line holding means may also slide in grooves in the side surfaces of the arc-shaped element.

The toothed belt 11 bears on the toothed arc-shaped element 14 inside the housing. The second wheel 9 and the third wheel 10 are positioned such that the toothed belt bears on part of the toothed arc-shaped element. The first wheel 8 is positioned such that the toothed belt will be parallel with the upper part of the body, i.e. parallel with a toothed rack 18 positioned in the housing. In order to function properly, the toothed belt extends over a part of the toothed arc-shaped element that is larger that the opening in the toothed arc-shaped element. In this way, it is ensured that the toothed belt will always be in contact with the toothed arc-shaped element and that the toothed arc-shaped element can be driven by the toothed belt. The toothed arc-shaped element will be pressed between the toothed belt and the rim of the opening in the body. The inside of the rim may therefore be provided with a low-friction treatment or other low-friction means. The toothed arc-shaped element is preferably made from a strong and rigid material. It can be cast or machined from a metal or may be made from a reinforced plastic, such as a fibre reinforced polyamid.

The housing is preferably also manufactured from a strong and rigid material. It can be cast or machined from a metal or may be made from a reinforced plastic, such as a fibre reinforced polyamid. When the housing is pressure moulded from a plastic, the spacers, grooves, fastening means and the like can be integrated in the mould. It is of advantage to manufacture the housing in a stainless and corrosion-free material.

In the housing, at the side opposite the recess 12, i.e. in the upper part of the body, a toothed beam or rack 18 is suspended. The teeth of the rack correspond to the teeth of the toothed belt. The housing 2 extends in a tube-shaped portion 19 that runs inside a handle 20. The handle is in this example an elongated tube, which may be of any desirable length. The handle is provided with a grip in the opposite end. The tube-shaped portion 19 is provided with two elongated openings 21 that run along the tube-shaped portion. The ends of the elongated openings will set the moving range of the rack. A pin 22 extends through the elongated openings. The pin 22 is fixed to the handle 20 and also to the toothed rack 18 inside the tube-shaped extension of the housing. In this way, the toothed rack can be moved back and forth by pulling and pushing the handle 20 in relation to the housing. The pulling direction of the handle is in the direction shown by arrow 25. When the handle 20 is moved with the housing being held in a fixed position, the toothed rack will move and thus the toothed belt will be moved by the toothed rack. When the toothed belt moves, it will in turn rotate the toothed arc-shaped element. Depending on the means to transfer the movement of the toothed rack to the arc-shaped element, the rotation of the arc-shaped element may be either clockwise or counter-clockwise for e.g. a pulling movement. The direction of rotation in the example below is counter-clockwise for a pulling movement, but the direction may be changed by using e.g. one or more toothed wheels between the toothed belt and the toothed rack.

FIGS. 3-6 demonstrate the threading action of the inventive threading device.

Figure 3:
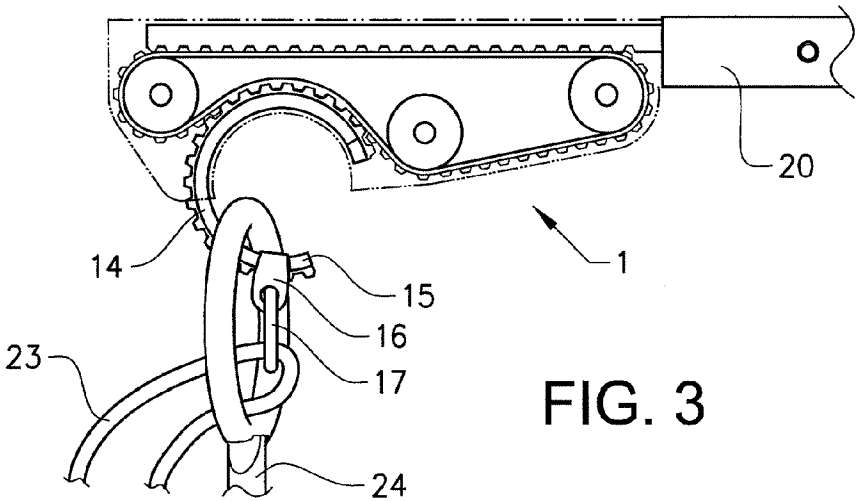
FIGS. 3-6 show a threading action using the threading device according to the first embodiment of the invention.

In FIG. 3, the threading device is shown in a first end position, which is the starting position for the threading cycle in this example. The line 23 that is to be thread through a mooring ring 24 is attached to the line holding means 16. The line holding means may be any suitable means that can hold the line during the threading cycle, e.g. a clamp, clip, shackle, ring or the like. In the shown example, the line holding means 16 comprises a ring 17 through which the line is thread. The line 23 is feed through the ring 17 in such a way that it does not fall off during the threading cycle, i.e. with some excessive length. If the line is provided with a loop or the like, it may also be attached to the ring 17 with a clamp of some kind. The ring 17 may be provided with some kind of friction or holding means, e.g. flexible tongues that will secure the line. With the line attached to the line holding means, the toothed arc-shaped element 14 of the threading device is positioned at the mooring ring so that the free end of the toothed arc-shaped element extends through the mooring ring together with the line holding means, i.e. the ring holding the line. The treading device will at the same time function as a boat hook, so that the boat can be held in position during the threading cycle.

Figure 4:
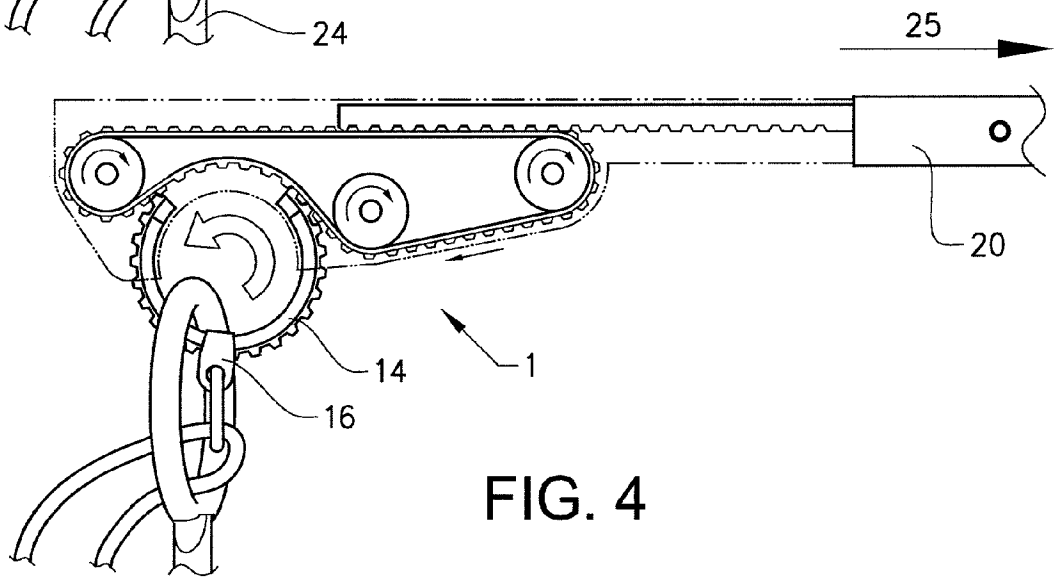

When the threading device bears on the mooring ring, the handle 20 of the threading device is pulled towards the user. Since the threading device will rest on the mooring ring, the handle and thus the toothed rack will move away from the mooring ring, causing the toothed arc-shaped element to rotate. Due to the toothed belt, the toothed arc-shaped element will rotate in a counter-clockwise direction when the handle is pulled. During the rotation of the toothed arc-shaped element, the mooring ring may bear either on the inner side of the arc-shaped element, on which it will glide, or on the rim of the housing. In FIG. 4, the toothed arc-shaped element has rotated about half-way through the threading cycle. The line holding means will glide on the toothed arc-shaped element and is here still in a lower position on the toothed arc-shaped element due to the weight of the line. The travel of the line holding means is limited either by one of the shoulders 15 of the arc-shaped element and the body or, as in FIG. 4, by the body alone.

Figure 5:
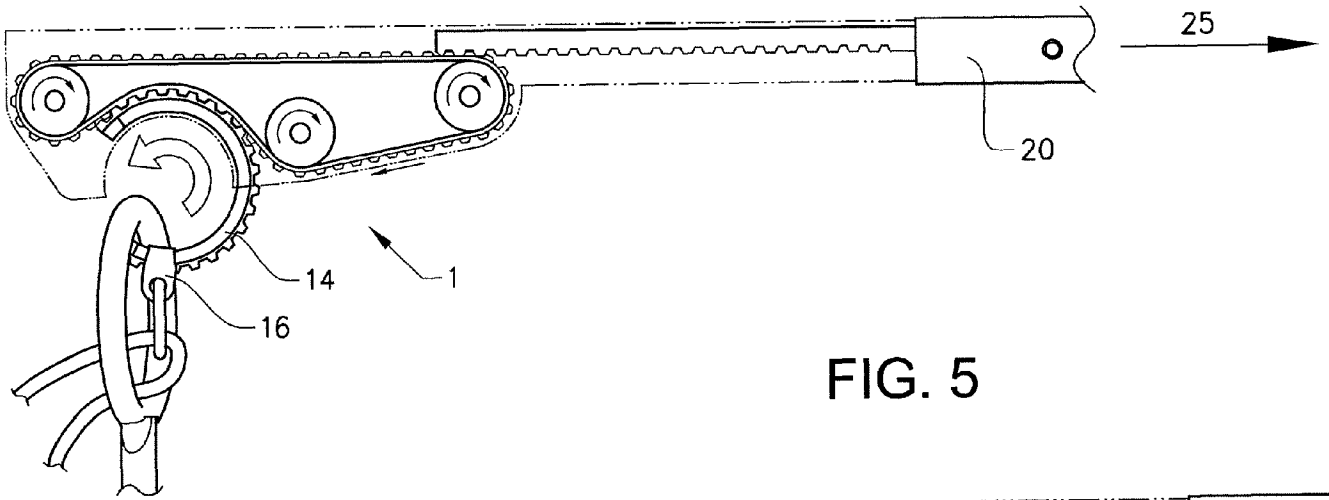
Figure 6:
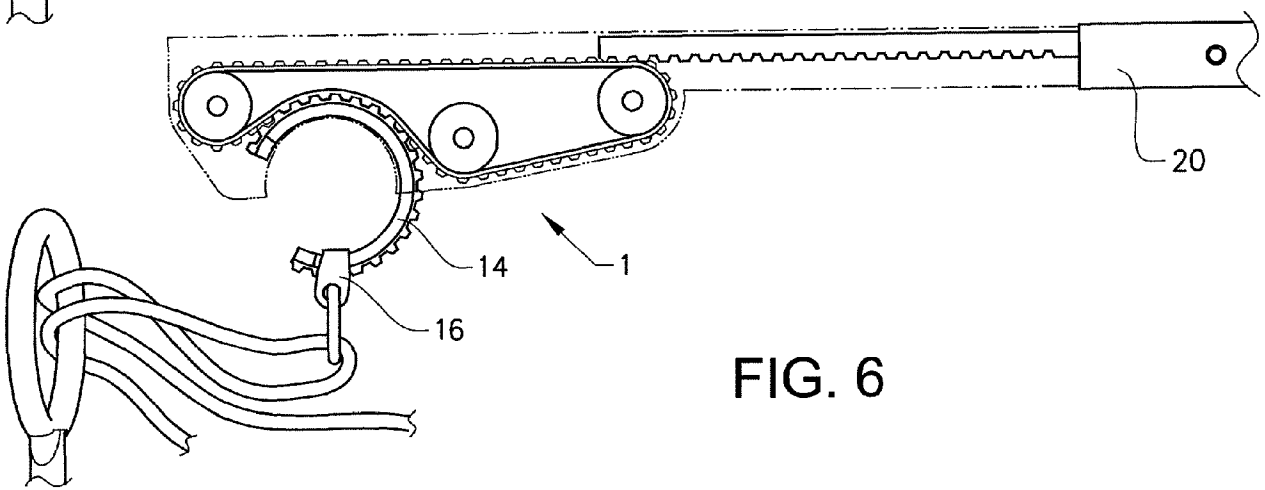

By continued pulling of the handle, the toothed arc-shaped element will continue to rotate and will reach its second end position as is shown in FIG. 5. In this position, the toothed arc-shaped element has reached its second end position and the opening of the toothed arc-shaped element is now directed away from the handle. The line holding means with the line now rests on a shoulder of the arc-shaped element. The pin 22 has reached the end of the elongated opening 21.

By a continued pulling of the handle, the complete threading device will move away from the mooring ring, since the opening of the arc-shaped element is now free form the mooring ring. At the same time, the line will be pulled through the mooring ring. The user may take the end of the line and secure it to the boat. The threading cycle is now completed.

The threading cycle can also be reversed, e.g. if the user decides to abort the landing for some reason. If the state of FIG. 5 is reached, and the user wants to abort the threading cycle, he/she may push the handle towards the mooring ring. The toothed arc-shaped element will now rotate in a clockwise direction since the rack is pushed towards the mooring ring. By pushing the handle to the first end stop, the state of FIG. 1 will be reached and the line is free of the mooring ring. The landing may now be aborted or another, more suitable mooring ring may be chosen instead.

It is also possible to use the reverse possibility to unthread a line from a mooring ring. This may be advantageous when the user does not want the line to fall in the water, e.g. if unpleasant substances or stinging jellyfish float in the water. In this case, the complete threading cycle is reversed.

In one development of the threading device, a chain may be used instead of the toothed belt. The teeth of the toothed rack and the toothed arc-shaped element are then adapted to the chain. It is also possible to use other types of belts or chains to transfer the movement of the handle to the toothed ring. It is however important that the transfer is more or less slip free. It is also possible to use a resilient element of some kind to move the toothed arc-shaped element back to the starting position. The resilient element may act directly on the toothed arc-shaped element or may act on the transfer means or an intermediate part. When the handle is released after a treading action is completed, the resilient element will rotate the toothed arc-shaped element back to the starting position.

Figure 14:
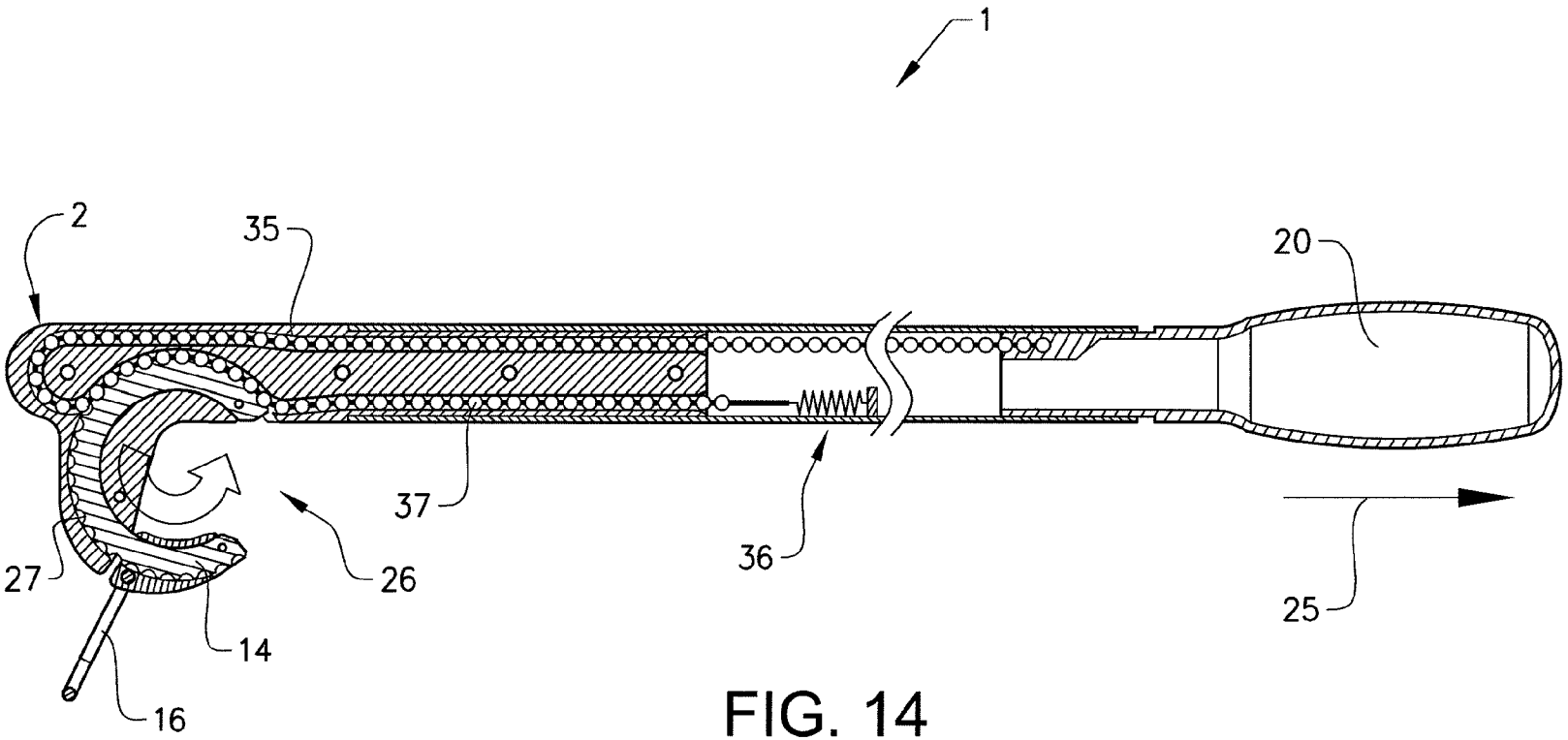
FIG. 14 shows another development of the first embodiment of the threading device according to the invention.

In one example, shown in FIG. 14, a ball chain is used as transfer means 18 to transfer the movement of the handle to the toothed arc-shaped element 14. The ball chain is in one end fixed to the handle 20 and runs in a groove 35 in the housing such that the ball chain bears on the toothed arc-shaped element. The ball chain runs in this example parallel with the upper side of the housing and changes direction at the front of the housing such that the toothed arc-shaped element will rotate in a counter-clockwise direction when the handle is pulled. The ball chain is in its other end attached to a resilient element 36, here shown as a coil spring. When the handle is pulled by a user, the ball chain rotates the toothed arc-shaped element from the first position to the second position, thereby treading the line attached to the line holding means 16 through a ring or the like. When the handle is released, the spring will pull the ball chain and thus the toothed arc-shaped element back to the first starting position. In the shown example, the housing is moulded such that the groove is created, which will guide the ball chain without the need of any other guiding means.

Figure 7:
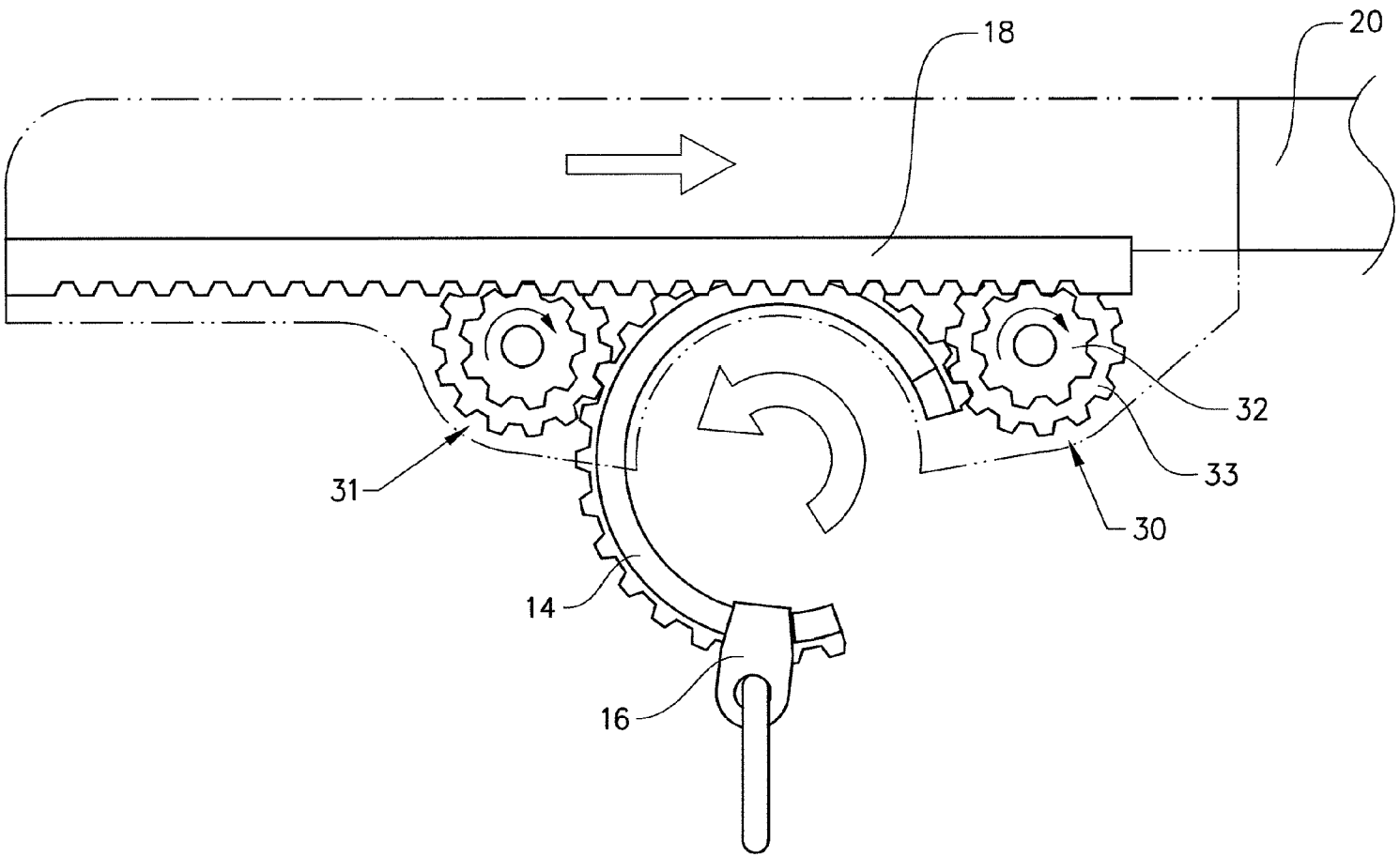
FIG. 7 shows a development of the first embodiment of the threading device according to the invention.

In another development of the threading device, shown in FIG. 7, the toothed belt and the wheels 8-10 are replaced with toothed wheels. In this example, a first toothed wheel 30 and a second toothed wheel 31 are used. The toothed wheels are positioned such that at least one toothed wheel will always be in contact with the toothed arc-shaped element. In this way, the toothed arc-shaped element can be rotated in the same way as described above. The position of the wheels and the size of the opening in the toothed arc-shaped element are thus depending on each other.

The size of the toothed wheels will set the gear ratio between the toothed rack and the toothed arc-shaped element. The toothed wheels may also consist of two differently sized sections, a first section 32 having a first radius and a second section 33 having a second radius. In the shown example, the radius 32 of the first section is smaller than the radius 33 of the second section. By selection of the radii, a desired gear ratio may be obtained.

In another development of the threading device, the toothed arc-shaped element is rotated from the grip end of the handle. This can be done in different ways. In one example, the toothed rack is extended through the handle and a grip is provided at the end of the extension. By holding the handle and at the same time operating the grip, the toothed rack can be moved back and forth, thereby rotating the toothed arc-shaped element. It is also possible to use a transmission so that the grip may operate the threading device by a rotational movement. Other ways of transferring the pulling or pushing movement of the handle or the grip to the rotating arc-shaped element are also possible.

In another development of the threading device, the toothed arc-shaped element is rotated by an external rotation. By replacing the toothed rack with a toothed wheel, the toothed belt may be rotated by the toothed wheel instead. The toothed wheel may e.g. be in connection with an electric motor that thus will rotate the arc-shaped element. The motor is preferably provided with a transmission having a suitable gear ratio. The handle may in this example be provided with batteries and switches to control the motor from the grip end of the handle. Other means of rotating the arc-shaped element is also possible. The motor may e.g. drive a worm wheel.

In another development of the threading device, the threading device is provided with a locking action. The locking action may be operated by a knob or the like on the handle. The locking action will block the movement of the toothed rack so that the arc-shaped element can not rotate. In this way, the threading device may be used as a regular boat hook. The locking action may either lock the threading device in the end positions or the locking position of the arc-shaped element may be freely chosen. With a selectable locking position, the threading device may be used as a type of gripping device.

Figure 8:
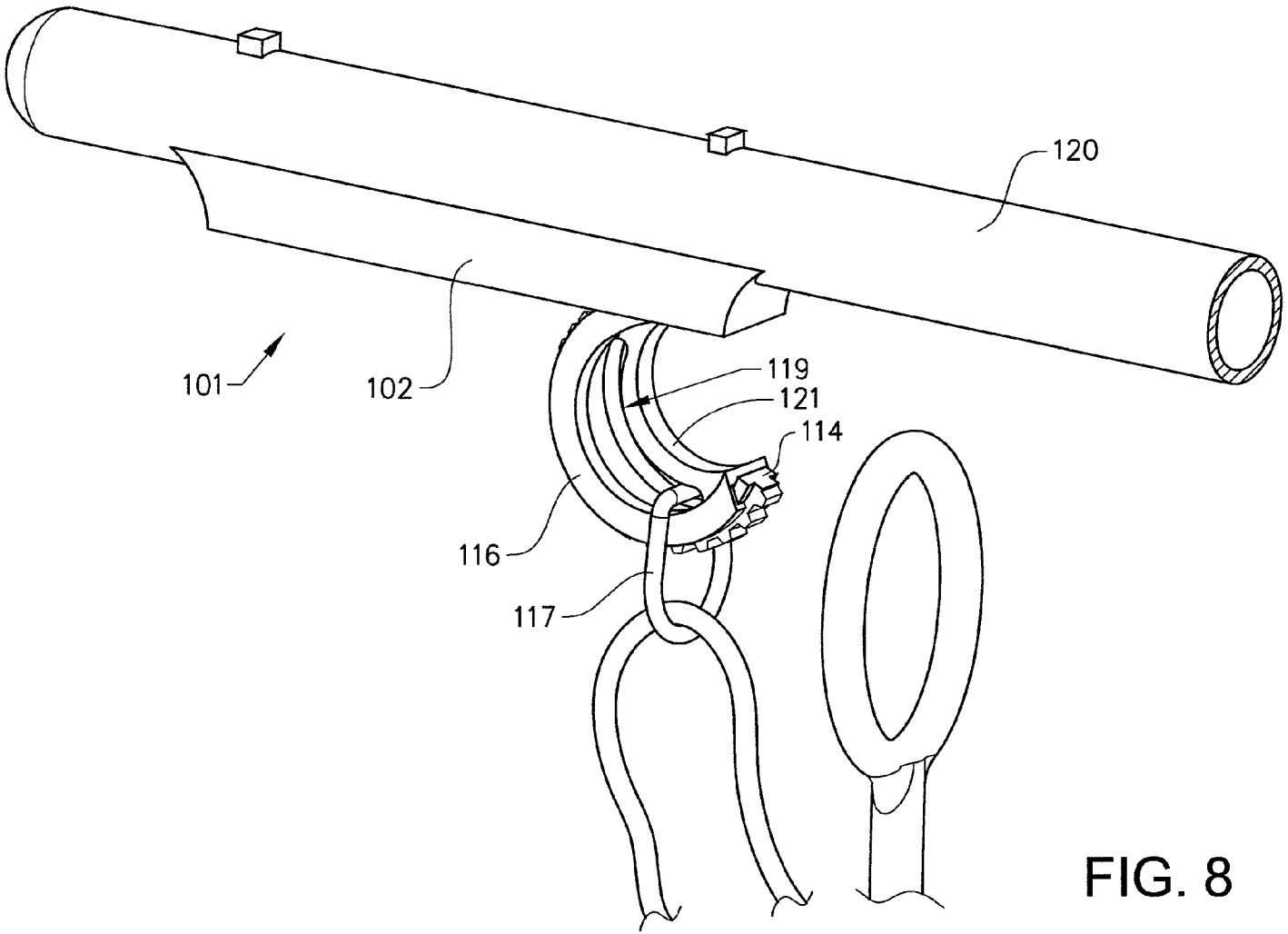
FIG. 8 shows a second embodiment of the threading device according to the invention.
Figure 9:
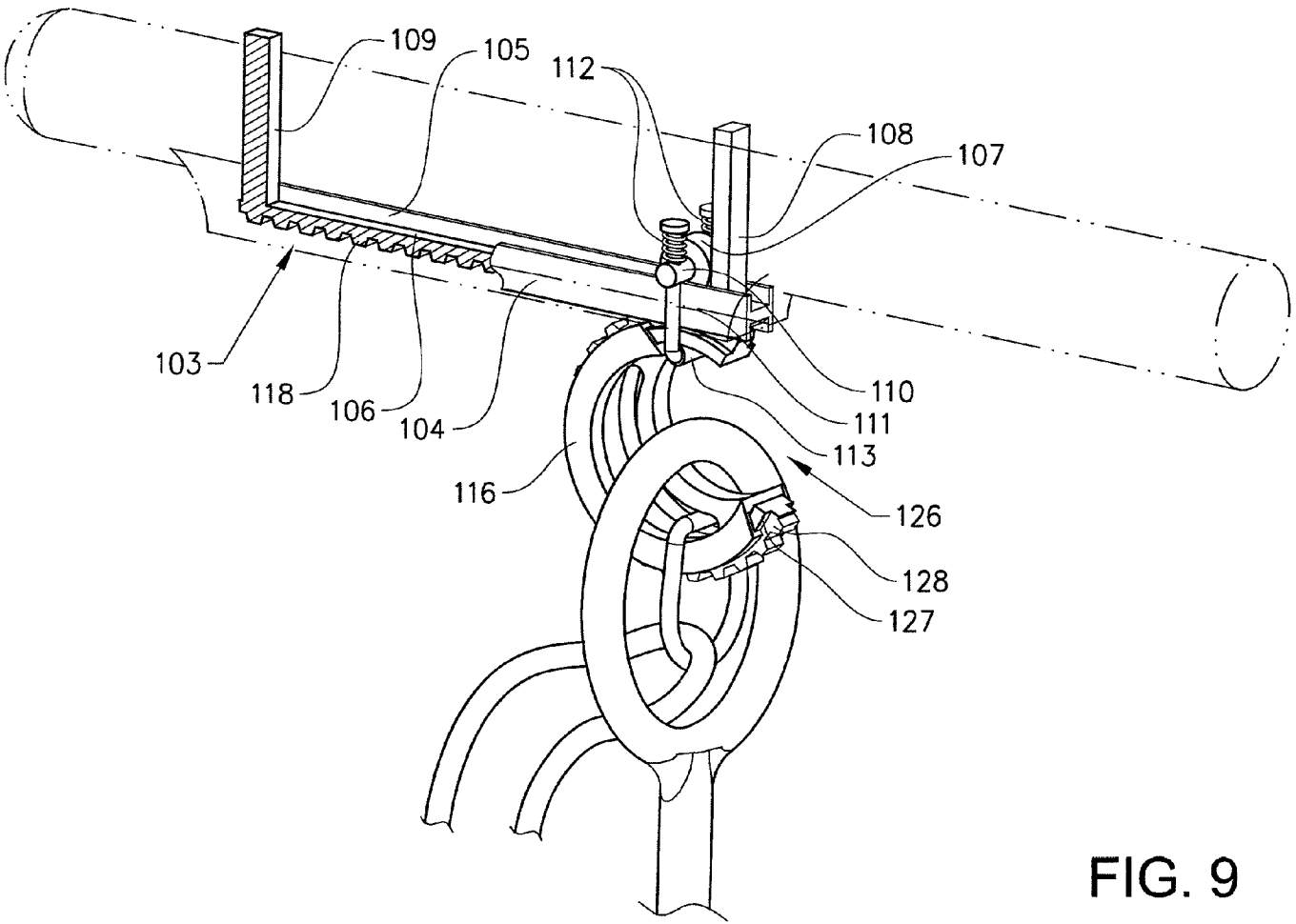
FIG. 9 shows a split view of the second embodiment of the threading device according to the invention.

In a second embodiment of the invention, as shown in FIGS. 8 and 9, the threading device 101 is adapted to be attached to a handle 120 with attachment means. In the shown embodiment, the threading device is fixed to the handle through two square openings, but several different ways of fixing the threading device to the handle are possible, such as screws or clamps. The advantage of having a separate threading device that can be fixed to a handle is that the threading device can be supplied as an accessory that can be mounted to an existing handle or the like by the user. The threading device may also be integrated into the handle and can thus also be supplied as a complete threading device unit.

The threading device 101 comprises a body portion 102. The threading device further comprises a central beam 103 having a first side wall 104 and a second side wall 105. The beam has a top surface 106 between the side walls that is flat and is adapted to convey a wheel 107. The wheel may be provided with side walls in order to guide the wheel instead of the side walls 104, 105. The beam is in this example delimited by two attachment means 108, 109. The opposite side of the top surface is adapted to transfer the movement of the beam to an arc-shaped element 114 in a high-friction manner such that the beam does not slip or skid on the arc-shaped element. In this example, the beam is provided with a plurality of teeth, resembling a toothed rack 108 integrated in the beam in order to prevent slippage, but also other means to prevent slippage are conceivable.

On the beam, a wheel 107 is provided that is adapted to roll on the top surface 106. The wheel is preferably made from a low-friction material. Through the wheel, an axle 110 is provided. The axle supports a carrying clamp 111, which in this example is suspended through the axle. On each arm of the clamp, between the axle and the end of the arms, a compression coil spring 112 is provided. The central part of the clamp may be provided with a rotating sleeve bearing 113 of some kind in order to reduce friction.

The threading device further comprises an arc-shaped element 114. In this example, the arc-shaped element is provided with teeth 128 on the outer surface 127. The toothed arc-shaped element is part-circular with an opening (126) preferably in the range between 60 and 120 degrees. The toothed arc-shaped element preferably has a rectangular cross section with the teeth extending outwards from the centre of the ring, as described further above. The toothed arc-shaped element is held to the beam by the clamp 111. In this way, the toothed arc-shaped element is pulled towards the beam by the springs 112. The teeth of the toothed rack will thus engage with the teeth of the toothed arc-shaped element. It is important that the toothed arc-shaped element does not slip in relation to the toothed rack. To ensure this, also other means than teeth may be used, e.g. pegs, ribs, grooves or splines.

In the toothed arc-shaped element, a line holding means 116 in the form of an inner, liner bushing is mounted. The line holding means can rotate relative the arc-shaped element and since the line holding means will rotate in an opposite direction as the arc-shaped element, the line holding means will pass the opening if the arc-shaped element. The angular extension of the line holding means must thus be greater than the opening of the arc-shaped element, and is preferably greater than 180 degrees. The line holding means is provided with rims holding the line holding means sideways in the arc-shaped element. The line holding means is provided with an elongated, curved opening 119 that may have the same radius as the arc-shaped element. The line holding means is further provided with a curved inner surface 121 having a radius that may be the same as the arc-shaped element or may be different. The inner surface 121 is adapted to bear on the mooring ring during at least part of the threading cycle. The size of the inner surface is adapted to the sizes of the mooring rings or the like to which the threading device is adapted for. The line holding means 116 is in this example provided with a ring 117 adapted to hold a line.

The springs pull the clamp towards the beam, and thus press the toothed arc-shaped element against the toothed rack. The springs provide flexibility to the clamp, which will allow the toothed arc-shaped element to rotate on the toothed rack when a force is applied to the toothed arc-shaped element. The toothed arc-shaped element is preferably made from a strong and rigid material. It can be cast or machined from a metal or may be made from a reinforced plastic, such as a fibre reinforced polyamid. It is of advantage to manufacture the arc-shaped element in a stainless and corrosion-free material.

FIGS. 10-13 demonstrate the threading action of the inventive threading device according to the second embodiment.

Figure 10:
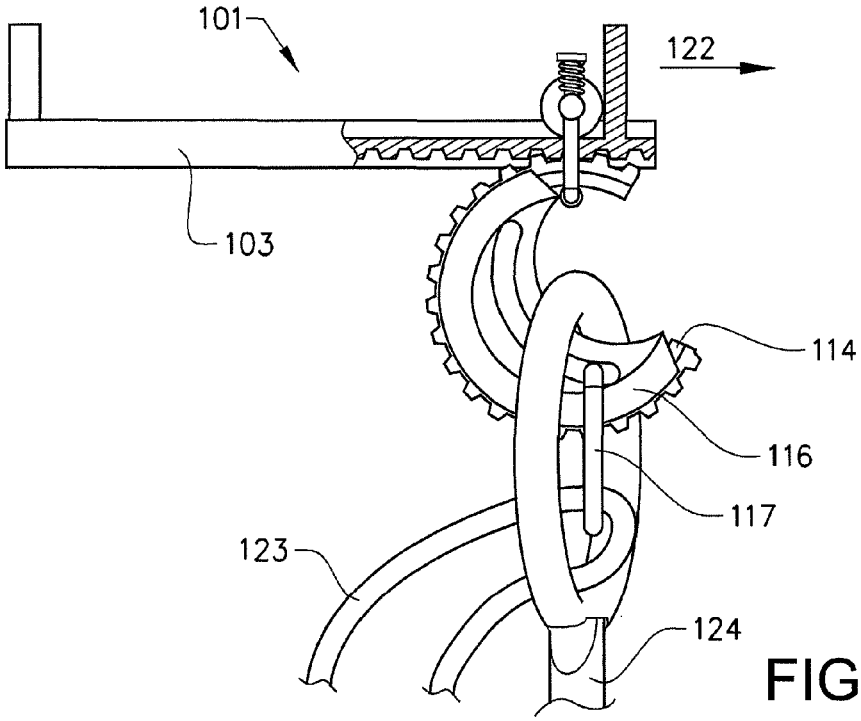
FIGS. 10-13 show a threading action using the threading device according to the second embodiment of the invention.

In FIG. 10, the threading device is shown in a first end position, which is the starting position for the threading cycle. The line 123 that is to be thread through a mooring ring 124 is attached to the line holding means 116. The line holding means may be any suitable means that can hold the line during the threading cycle, e.g. a clamp, clip, shackle, ring or the like. In the shown example, the line holding means 116 comprises a ring 117 through which the line is thread. The line 123 is feed through the ring 117 in such a way that it does not fall off during the threading action. If the line is provided with a loop or the like, it may also be attached to the ring 117 with a clamp of some kind. The ring 117 may be provided with some kind of holding means, e.g. flexible tongues that will secure the line. It would also be possible to thread the line trough an opening in the line holding means, the line opening replacing the elongated opening. In this case, the opening would preferably be positioned symmetric in the line holding means. With the line attached to the line holding means, the arc-shaped element 114 of the threading device together with the line holding means is positioned at the mooring ring so that the free end of the arc-shaped element extends through the mooring ring together with part of the line holding means holding the line. The treading device will at the same time function as a boat hook, so that the boat can be held in position during the threading cycle.

When the inner surface of the line holding means bears on the mooring ring, the handle and thus the threading device is pulled towards the user in the direction indicated by arrow 122. Since the line holding means will rest on the mooring ring, there will be a force acting on the line holding means from the mooring ring due to the pulling of the handle. The force of the line holding means will act on the toothed arc-shaped element which in turn will pull the clamp somewhat downwards and will also incline the clamp somewhat in a direction opposite arrow 122. The springs 112 allow this flexing of the clamp and this in turn will permit the toothed arc-shaped element to rotate relative the toothed rack. The toothed arc-shaped element will rotate in a clockwise direction. At the same time, the line holding means will rotate in a counter-clockwise direction. The angular position of the line holding means may vary during the cycle due e.g. to the weight of the line and to the position on which the mooring ring bears on the toothed arc-shaped element.

Figure 11:
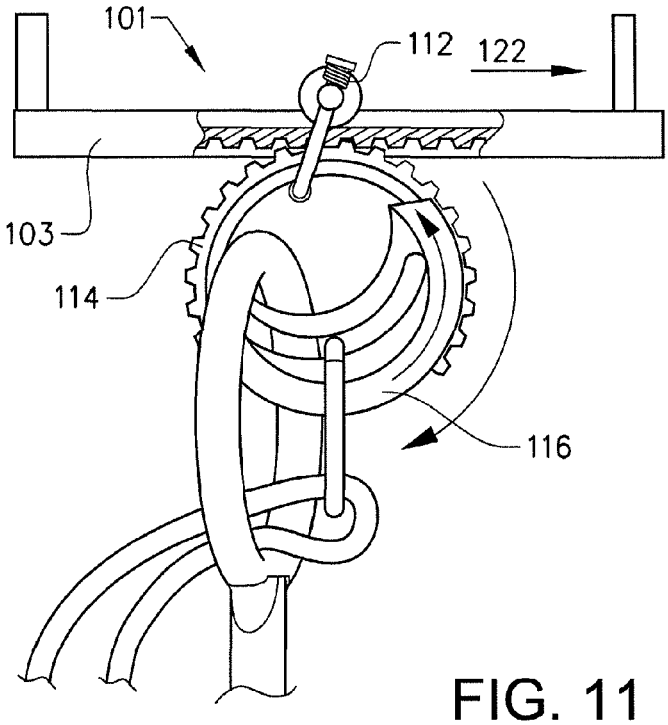

During the rotation of the toothed arc-shaped element, the line holding means may glide in the toothed arc-shaped element and is balanced from the weight of the line. Depending on the position of the line holding means, the position of the ring holding the line will vary in the elongated opening. In FIG. 11, the toothed arc-shaped element has rotated about half-way through the threading cycle.

Figure 12:
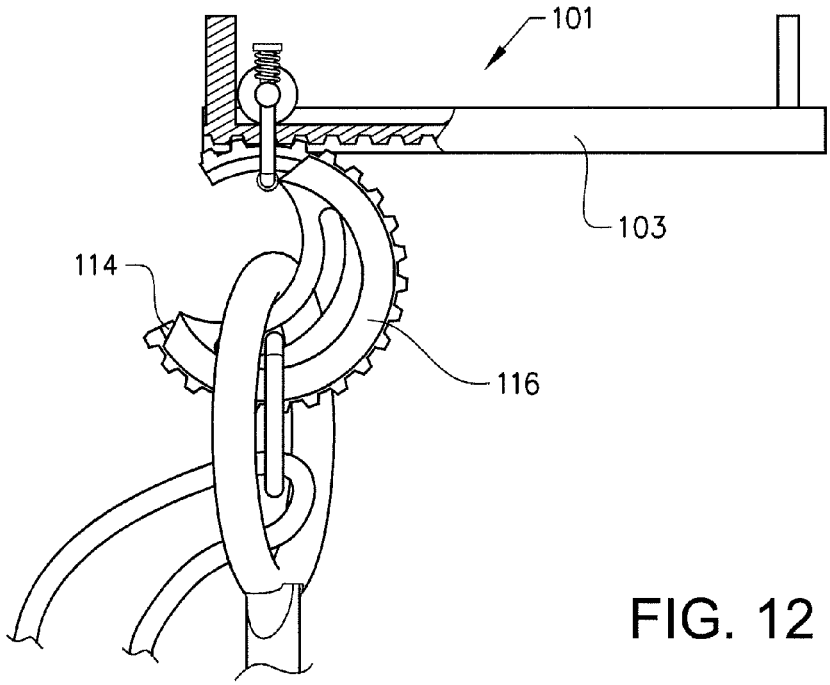
Figure 13:
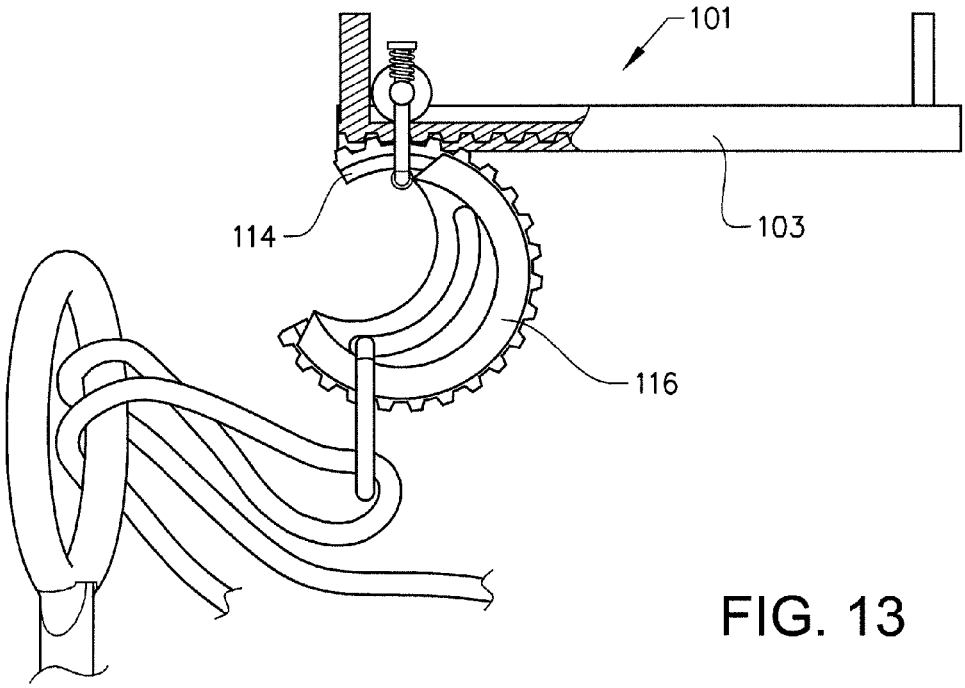

By continued pulling of the handle, the toothed arc-shaped element will continue to rotate and will reach its second end position as is shown in FIG. 12. In this position, the toothed arc-shaped element has reached its second end position and the opening is now directed away from the handle. The line holding means with the line has also rotated and may now bear on the rotating sleeve bearing 113 from the other side.

By a continued pulling of the handle, the complete threading device will move away from the mooring ring, since the opening of the toothed arc-shaped element is now free from the mooring ring. Should the line holding means be in a more horizontal position, it will move to the position shown in FIG. 12 during this pulling, either by the contact with the mooring ring or by the weight of the line or a combination of the two. At the same time, the line will be pulled through the mooring ring. The user may now take the end of the line and secure it to the boat. The threading cycle is now completed.

The threading cycle can also be reversed, e.g. if the user decides to abort the landing for some reason. If the state of FIG. 12 is reached, and the user wants to abort the threading cycle, he/she may push the handle towards the mooring ring. The arc-shaped element will now rotate in a counter-clockwise direction and the line holding means in a clockwise direction since the handle and thus the rack is pushed towards the mooring ring. The clamp will in this case flex in the opposite direction in order to allow the arc-shaped element to rotate. By pushing the handle to the first end stop, the state of FIG. 10 will be reached and the line is free of the mooring ring. The landing may now be aborted or another, more suitable mooring ring may be chosen instead.

It is also possible to use the reverse possibility to unthread a line from a mooring ring. This may be advantageous when the user does not want the line to fall in the water, e.g. if unpleasant substances or stinging jellyfish float in the water. In this case, the complete threading cycle is reversed.

In a development of the threading device, the toothed arc-shaped element is rotated from the grip end of the handle. This can be done in different ways. In one example, the toothed beam is suspended in a gliding manner in the body. The beam is extended through the handle and a grip is provided at the end of the extension. By holding the handle and at the same time operating the grip, the toothed beam can be moved back and forth, thereby rotating the toothed arc-shaped element. It is also possible to drive the wheel with the clamp from the grip of the handle by using a force transfer means to push and pull the wheel. Other ways of transferring the pulling or pushing movement of the handle or the grip to the rotating arc-shaped element are also possible. It is also possible to rotate the arc-shaped element with an electric motor provided with a transmission. The motor may drive the arc-shaped element directly or may drive the toothed rack.

The invention is not to be regarded as being limited to the embodiments described above, a number of additional variants and modifications being possible within the scope of the subsequent patent claims. It is e.g. possible to integrate the threading device in different types of handles, and the rotatable, arc-shaped element can be suspended in the body of the threading device in a number of ways encompassed by the claims.

Reference signs

1: Threading device

2: Body

3: First side wall

4: Second side wall
5: First bolt
6: Second bolt
7: Third bolt
8: First wheel
9: Second wheel
10: Third wheel
11: Toothed belt
12: Recess
13: Rim
14: Arc-shaped element
15: Shoulder
16: Line holding means
17: Ring
18: Toothed rack
19: Tube-shaped extension
20: Handle
21: Elongated opening
22: Pin
23: Line
24: Mooring ring
25: Pulling direction
26: Opening
27: Outer surface
28: Tooth
31: First toothed wheel
32: Second toothed wheel
33: First section
34: Second section
35: Groove
36: Resilient element
37: Ball chain
101: Threading device
102: Body
103: Beam
104: First side wall
105: Second side wall
106: Top surface
107: Wheel
108: Attachment means
109: Attachment means
110: Axle
111: Clamp
112: Spring
113: Sleeve bearing
114: Arc-shaped element
116: Line holding means
117: Ring
118: Toothed rack
119: Elongated opening
120: Handle
121: Inner surface
122: Pulling direction
123: Line
124: Mooring ring
126: Opening
127: Outer surface
128: Tooth

The invention claimed is:

1. A threading device for the threading of a line through a ring member, said threading device comprising:

a body;

a rotatable arc-shaped element suspended in said body, said arc-shaped element having an outer surface, and an opening defined through said arc-shaped element, where said arc-shaped element is moveable to assume a first position with said opening in a first direction and a second position with said opening in a second direction;

a line holding means arranged to slide on said arc-shaped element; and a transfer means configured to transfer a movement to said outer surface of said arc-shaped element in order to rotate said arc-shaped element between said first and said second position.

2. The threading device according to claim 1, wherein the movement transferred to said outer surface of said arc-shaped element is longitudinal and that said transfer means is a ball chain.

3. The threading device according to claim 1, wherein said arc-shaped element further comprising a plurality of teeth on said outer surface.

4. The threading device according to claim 3, wherein the movement transferred to said outer surface of said arc-shaped element is longitudinal and that said transfer means is a beam.

5. The threading device according to claim 4, wherein said beam comprising a plurality of teeth.

6. The threading device according to claim 5 further comprising a plurality of toothed wheels configured to transfer the movement of said beam to said arc-shaped element.

7. The threading device according to claim 5 further comprising a toothed belt configured to transfer the movement of said beam to said arc-shaped element.

8. The threading device according claim 1 further comprising a handle configure to impart the movement achieved by the pulling or the pushing of said handle.

9. The threading device according to claim 1, wherein said line holding means is configured to rotate over said opening in said arc-shaped element.

10. The threading device according to claim 1 further comprising a resilient element configured to pull said arc-shaped element back to said first position.

11. The threading device according to claim 1, wherein said line holding means further comprising a liner bushing mountable to an inner radius of said arc-shaped element and rotatable relative said arc-shaped element in an opposite direction, said bushing having an angular extension greater than said opening of said arc-shaped element allowing said bushing to pass over said opening of said arc-shaped element.

12. The threading device according to claim 11, wherein said bushing is provided with a curved opening and a curved inner surface, both of which having a radius equal to that of said arc-shaped element, wherein said inner surface is configured to bear on said line holding means during at least part of said first and second position.

13. A threading device comprising:

a body;

a rotatable arc-shaped element suspended in said body, said arc-shaped element having an outer surface, a plurality of teeth on said outer surface, and an opening defined through said arc-shaped element, where said arc-shaped element is moveable to assume a first position with said opening in a first direction and a second position with said opening in a second direction;

a line holding means arranged to slide on said arc-shaped element; and a transfer means having a plurality of teeth configured to transfer a movement to said outer surface of said arc-shaped element in order to rotate said arc-shaped element between said first and said second position.

14. The threading device according to claim 13, wherein the movement transferred to said outer surface of said arc-shaped element is longitudinal and that said transfer means is a beam.

15. The threading device according to claim 14 further comprising a plurality of toothed wheels configured to transfer the movement of said beam to said arc-shaped element.

16. The threading device according to claim 15, wherein said arc-shaped element is located between said toothed wheels.

17. The threading device according to claim 14 further comprising a toothed belt configured to transfer the movement of said beam to said arc-shaped element, and a plurality of wheels engagable with said toothed belt so that said toothed belt is engagable with said teeth of said beam and said teeth of said outer surface of said arc-shaped element.

18. The threading device according to claim 14, wherein said body further comprising a first side wall and a second side wall, said first and second side walls being configured to receive therebetween a portion of said arc-shaped element.

19. The threading device according to claim 14, wherein said line holding means further comprising a liner bushing mountable to an inner radius of said arc-shaped element and rotatable relative said arc-shaped element in an opposite direction, said bushing having an angular extension greater than said opening of said arc-shaped element allowing said bushing to pass over said opening of said arc-shaped element.

20. The threading device according to claim 18, wherein said bushing is provided with a curved opening and a curved inner surface, both of which having a radius equal to that of said arc-shaped element, wherein said inner surface is configured to bear on said line holding means during at least part of said first and second position.

* * * * *